United States Patent [19]

Cosby et al.

[11] Patent Number: 4,521,012

[45] Date of Patent: Jun. 4, 1985

[54] VARIABLE RESISTANCE EXERCISE APPARATUS AND IMPROVED METHOD OF EXERCISING

[75] Inventors: Theodore E. Cosby, Newport Beach, Calif.; Patrick J. Cunningham, 600 Ladera Vista Way, Fullerton, Calif. 92631

[73] Assignee: Patrick J. Cunningham, Fullerton, Calif.

[21] Appl. No.: 462,555

[22] Filed: Jan. 31, 1983

[51] Int. Cl.[3] ..... A63B 21/22

[52] U.S. Cl. ..... 272/73; 272/130

[58] Field of Search ..... 272/73, 130, 132; 128/25 R

[56] References Cited

U.S. PATENT DOCUMENTS

| | | | |
|---|---|---|---|
| 1,820,372 | 8/1931 | Blomquist | 272/73 |
| 2,020,992 | 11/1935 | Caplan | 128/25 R |
| 2,783,044 | 2/1957 | Sbarra | 272/73 X |
| 3,309,084 | 3/1967 | Simmons | 272/73 X |
| 3,494,616 | 2/1970 | Parsons | 272/130 X |
| 3,572,699 | 3/1971 | Nies | 128/25 R |
| 3,731,921 | 5/1973 | Andrews | 272/132 |
| 4,060,241 | 11/1977 | Hegel | 272/132 |
| 4,222,376 | 9/1980 | Praprotnik | 272/73 |

FOREIGN PATENT DOCUMENTS

| | | | |
|---|---|---|---|
| 730035 | 3/1966 | Canada | 272/73 |
| 1070769 | 2/1954 | France | 128/25 R |
| 608121 | 9/1960 | Italy | 272/73 |
| 1153143 | 5/1969 | United Kingdom | 272/130 |

*Primary Examiner*—Richard J. Johnson

*Attorney, Agent, or Firm*—Hubbard & Stetina

[57] ABSTRACT

A variable resistance exercise apparatus is disclosed specifically adapted to provide an improved method or aerobic and anaerobic exercising of the upper extremities and upper body portion of a user. The apparatus is characterized by the use of a hand crank assembly adjustably positioned at a vertical height above a support platform to cause a user to reach and twist during exercise upon the apparatus. The length of the hand crank assembly may be adjusted to accommodate differing extremity lengths of the particular user and the exercise resistance load applied to the hand crank may be varied to accommodate both professional athletic training as well as residential fitness programs.

11 Claims, 6 Drawing Figures

VARIABLE RESISTANCE EXERCISE APPARATUS AND IMPROVED METHOD OF EXERCISING

BACKGROUND OF THE PRESENT INVENTION

The present invention relates to exercise equipment and more particularly to a variable resistance exercise apparatus which is specifically adapted to provide an improved method of aerobic and anaerobic exercising of the upper extremity and upper body portions of a user.

It is now generally recognized in the medical profession that routine exercise programs are beneficial, if not necessary, to improved cardiovascular, pulmonary, and neuro-muscular health. The recognition of these benefits associated with routine exercise has resulted in a substantial number of the general public as well as professional athletes participating in various exercise programs such as jogging, weightlifting, aerobic dancing, and/or cycling. Although all of these exercise programs have proven beneficial in their general application, they each possess certain deficiencies which have detracted from their overall effectiveness.

With specific relation to weightlifting and weight apparatus, the resultant exercise has primarily been limited to the development of specific isolated muscles in the body with such exercise failing to provide any significant interaction between related muscle groups of the body. With reference to aerobic dancing and jogging, the exercise programs have usually been impaired by their inability to apply a significant enough resistance load to the exercise to permit full muscle development. Similarly, jogging and aerobic dancing as well as the cycling apparatus programs have typically been deficient in that only the lower extremities of the users have been exercised.

As such, there exists a substantial need in the art for an improved exercise apparatus and method of exercising which provides an interaction between related muscle groups of the body, permits the application of a variable exercise load into the exercise program, and effectively exercises the upper extremities and upper body portions of the user.

SUMMARY OF THE PRESENT INVENTION

The present invention specifically addresses and alleviates the above-referenced deficiencies associated in the art. More particularly, the present invention comprises a variable resistance exercise apparatus specifically adapted to provide an improved method of aerobic and anaerobic exercising of the upper extremities and body portions of a user. The particular exercise apparatus of the present invention when utilized in conjunction with other conventional exercise programs such as cycling or jogging has been found to insure a complete exercise program for the individual user.

The apparatus of the present invention is characterized by a support platform adapted to be stood upon by a user including a vertically extending column having a hand crank assembly mounted thereon. The column may be adjusted to a height dependent upon the size of the user to cause a full extension of the upper extremities (i.e., stretching) when the crank assembly is grasped in the hands of the user. Upon manual movement of the cranks, the user's body is additionally required to rotate (i.e., twist) about the waist and hips. This particular reaching and twisting motion utilized in the method of the present invention has been found to provide significant exercise to the arms, shoulders, neck, chest, abdomen, and waist of a user.

To augment the benefits of the particular reaching and twisting motion, the present invention incorporates a hydraulic pump which applies a variable exercise or resistance load to the hand crank assembly. As such, the apparatus permits purposeful stressing of the user which enables the device to be effective in residential fitness as well as professional athletic training applications.

The exercise apparatus of the present invention additionally includes a speed sensor adapted to yield a visual display of the revolutions of the hand crank during the exercise program and a timing device which advantageously indicates the desired overall exercise time and elasped exercise time.

The present invention further includes means for adjusting the length of the crank assembly to allow the apparatus to precisely suit differing extremity lengths of users and further includes a pair of rollers integrated into the platform to permit rapid transport of the apparatus.

DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
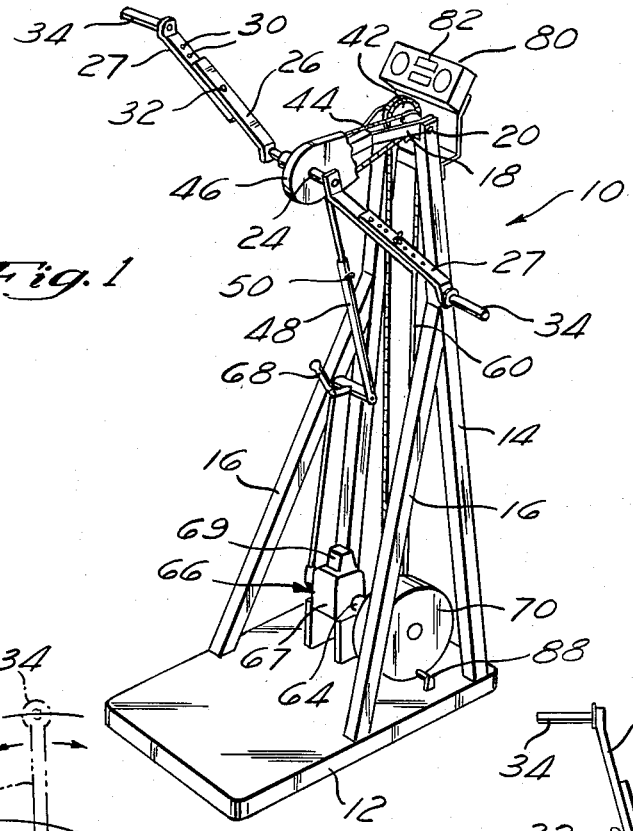
FIG. 1 is a perspective view of the exercise apparatus of the present invention.

Referring to FIG. 1, there is shown the variable resistance exercise apparatus of the present invention designated generally by the numeral 10. The apparatus 10 is composed of a platform 12, one end of which is adapted to be stood upon by a user and a generally A-shaped column 14 extending vertically upward from the platform 12. In the preferred embodiment, the platform 12 and column 14 are fabricated from square metal tubing sufficient to provide a rugged structure; however, other tubing configurations and material may additionally be utilized. The column 14 is advantageously supported by a pair of angularly extending struts 16 which are mounted to the column 14 and base 12 as by way of a fillet weld to rigidify the structure of the apparatus 10.

Figure 4:
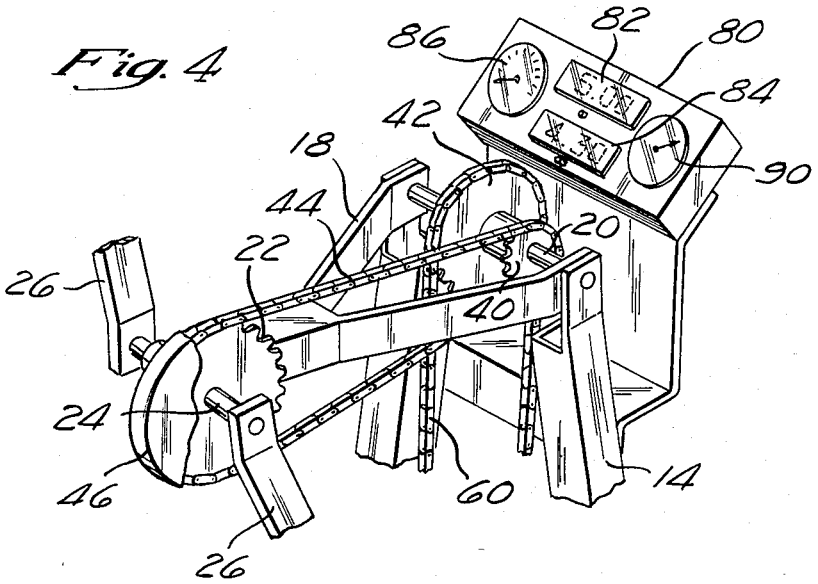
FIG. 4 is an enlarged perspective view of the crank assembly of the present invention.

As best shown in FIG. 4, the uppermost end of the column 14 mounts a generally Y-shaped yoke 18 which is pivotally connected at one end to the column 14 as by way of a shaft 20. The opposite end of the yoke 18 carries a gear 22 which is rotatably mounted for movement about a shaft 24 extending through the yoke 18. Opposite ends of the shaft 24 mount a hand crank assembly 26 composed of a pair of juxtoposed elongate members which extend angularly outward from the axis of the shaft 24. The outboard elongate members 27 of the crank assembly 26 include a plurality of apertures 30 positioned axially along their length each sized to receive a wing nut bolt fastener 32. The distal end of each of the outboard members 27 is provided with a handle 34 mounted for rotational movement and adapted to be grasped in the hand of a user. As will be recognized, by this particular arrangement, the effective length of the crank assembly 26 may be adjusted by positioning of the wing nut bolt 32 in a desired aperture 30 of the outboard elongate members 27.

Figure 2:
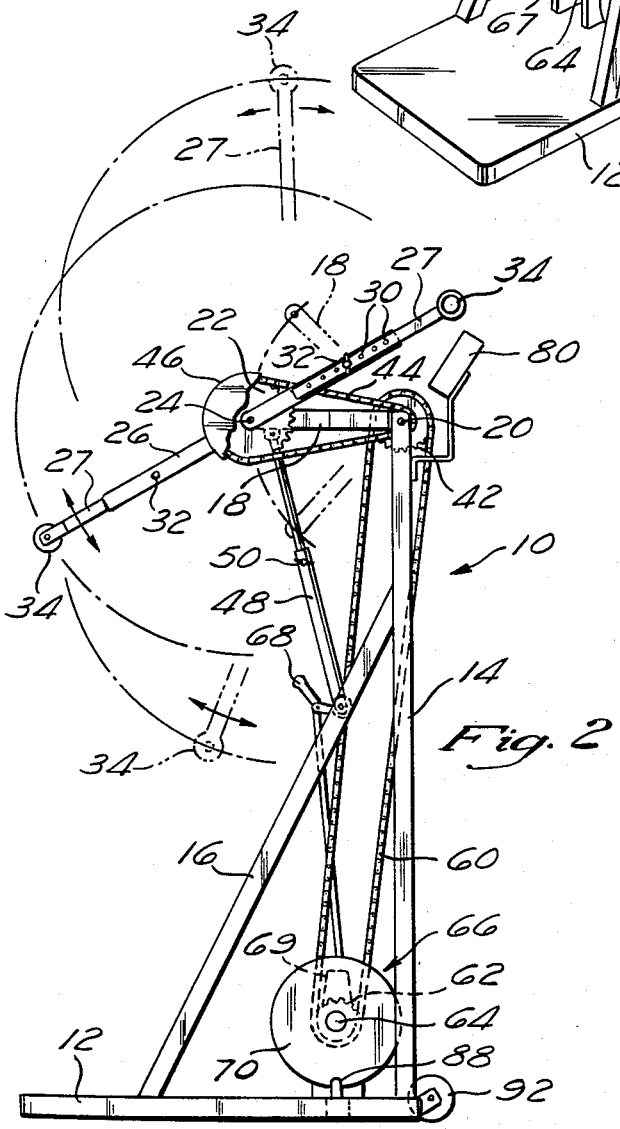
FIG. 2 is an elevational view of the exercise apparatus of the present invention illustrating the vertical adjustment of a hand crank assembly mounted thereon.
Figure 3:
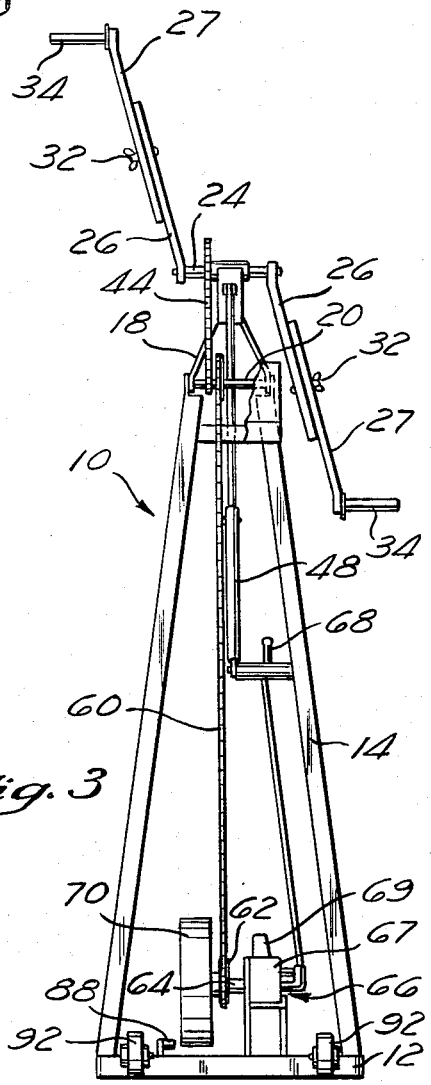
FIG. 3 is a front elevational view of the exercise apparatus of the present invention.

The shaft 20 carries a pair of preferably dissimilar sized gears or sprockets 40 and 42 which rotate in unison upon the shaft 20. As best shown in FIGS. 2 and 4, the gear 40 communicates with the gear 22 of the crank assembly 26 via a chain drive 44, which chain drive is preferably covered by a protective shroud or housing 46. The outboard end of the yoke 18 is pivotally attached to a telescoping sleeve arrangement 48 which is mounted on its lowermost end to one of the angular support struts 16. A wind nut 50 is provided on the telescoping sleeve assembly 48 to lock the sleeve assembly 48 at a desired axial length. As will be recognized, due to the yoke 18 being pivotally mounted to the shaft 20, the vertical elevation of the crank assembly 26 relative the support platform 12 may be easily adjusted merely by loosening of the wing nut 50 rotating or pivoting the yoke 18 either in a clockwise or counterclockwise direction (as indicated by the phantom lines in FIG. 2) and subsequently locking the yoke 18 in a desired position by retightening of the wing nut fastener 50 on the telescoping sleeve assembly 48.

The gear or sprocket 42 mounted upon the shaft 20 communicates via a chain drive 60 with a gear or sprocket 62 disposed adjacent the platform 12. The gear 62 is rigidly connected to the output shaft 64 of an exercise load regulating means designated generally by the numeral 66. In the preferred embodiment, the load regulating means 66 comprises a hydraulic pump 67 having a pressure regulator valve 69 adapted to vary the pressure and thus vary the output torque of the pump 67 applied to the gear 62. As will be recognized, the direction of the rotational load applied by the load regulating means 66 to the gear 62 is in opposition to the rotational force applied by the hand crank assembly 26 to cause greater exertion to be applied by the user during the exercise program. A manually actuated lever and linkage 68 is connected to the pressure regulator valve of the load regulator means 66 to permit the magnitude of the counter rotational torque to be rapidly varied by a user. To reduce minor speed variations in the rotational speed of the gear 62, a high mass fly wheel 70 is preferably disposed upon the output shaft 64 of the load regulating means 66.

A display panel 80 is attached to the uppermost end of the column 14 and preferably includes gauge and display devices for communicating information related to the exercise operation to the user. In the preferred embodiment, the display 80 includes a conventional timing mechanism having a pair of digital displays 82 and 84 adapted to provide an overall exercise time and elasped exercise time display, respectively, to the user. In addition, a gauge 86 may be provided to indicate the number of revolutions per minute of the fly wheel 70 which gauge is responsive to signals obtained from a speed sensor 88 positioned adjacent the fly wheel 70. A percentage load indicator 90 may further be utilized to indicate the magnitude of the counter rotational torque being applied during the exercise program by the load regulating means 66.

A pair of wheels 92 is positioned upon the platform 12 to permit the apparatus 10 to be rapidly transported to a desired location. Advantageously, the wheels 92 are positioned such that their periphery is raised slightly above the lower planar surface of the platform 12 so as not to contact the floor when the apparatus 10 is being utilized. However, when it is desired to transport the apparatus, the apparatus 10 may be pivoted about the wheels 90 such that the wheels support the entire weight of the apparatus 10 during transport.

With the structure defined, the operation of the apparatus 10 of the present invention may be described. Initially, the vertical position and length of the hand crank assembly 26 must be adjusted for the particular user. This initial adjustment is effectuated by loosening of the wing nut 50 and rotating the yoke 18 either in a clockwise direction to increase the height of the crank assembly 26 from the support platform 12, or in a counterclockwise direction to decrease the height from the platform 12. When properly positioned, the wing nut 50 may be manually tightened to lock the yoke 18 in its desired position. In addition, the length of the hand crank assembly 26 may be adjusted to the particular user by selectively positioning the wing nut bolt assemblies 32 into one of the desired apertures 39 of the hand crank assembly 26.

It is an important feature of the present invention that the initial adjustment of the apparatus 10 is effectuated to require a full extension of the upper extremities of the user when the handle 34 of the crank assembly 26 are positioned at their uppermost vertical orientation. This extended position is indicated in FIG. 6 whereby the left side of the user's body is placed in a stretching motion as indicated by the arrow in FIG. 6 causing the abdomen, chest, and left arm to be fully extended.

Positioned in such a manner and by grasping both of the handles 34 of the crank assembly 26, the user subsequently rotates the hand crank assembly 26 in a cycling motion as in the direction indicated by the arrows in FIG. 6.

Figure 5:
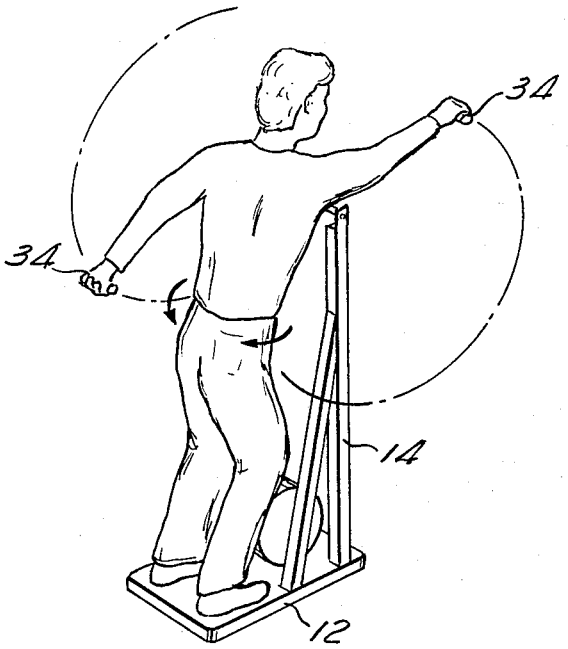
FIG. 5 is a schematic view of the twisting motion of the user during exercise upon the exercise apparatus of the present invention.
Figure 6:
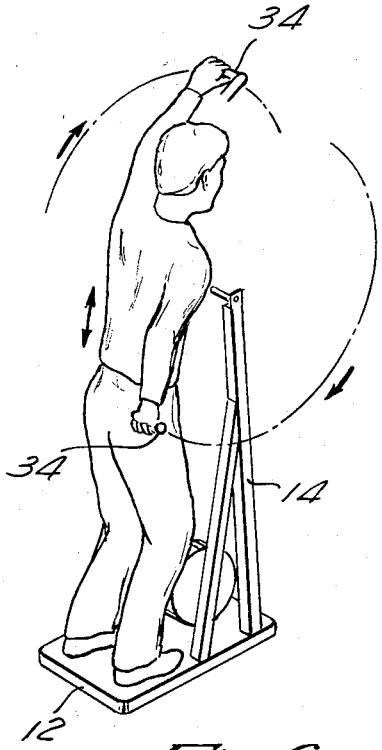
FIG. 6 is a schematic view of the reaching motion of a user during exercise upon the exercise apparatus of the present invention.

Upon rotation from the maximum extension position indicated in FIG. 6 to a position wherein both of the handles 34 of the crank assembly 26 are disposed in a horizontal plane, the user's body will twist or rotate about the hips and waist as indicated by the arrows in FIG. 5 thereby providing exercise of the waist and muscles of the abdomen, chest, back and shoulders. As will be recognized, by continued rotational movement of the hand crank assemblies, this reaching and twisting motion is repeated causing a full interactive exercise or the upper extremeties and upper body portions of the user.

To improve the quality of the exercise program, a user simply adjusts the counter-rotational force being applied to the hand crank assembly 26 by manual adjustment of the lever 68 which causes a corresponding throttling of the load regulating means 66. The particular exercise program may, of course, be continued for any desired length of time, however preferably, is continued only for the predetermined exercise time entered into the overall time display 82 and indicated on the elasped time display 84. In addition, during the exercise program, the user can continuously monitor the rotational speed of the hand cranks by the visual rotational speed display 86.

Thus, in summary, the present invention provides a significantly improved exercise apparatus which enables both aerobic and anaerobic exercise of the upper extremities and upper body portion of a user. Although in the preferred embodiment certain material sizes and configurations have been illustrated, those skilled in the art will recognized that various modifications can be made to the same without departing from the spirit of the present invention and that such modifications are anticipated within the scope of the present invention.

What is claimed is:

1. An improved exercise apparatus comprising:

a platform adapted to be positioned upon a support surface;

a column extending from said platform in a generally vertical orientation, said column comprising a pair of struts extending from said platform;

a shaft mounted between said struts;

a yoke having a first end pivotally connected to said shaft and a second end extending away from said shaft;

a hand crank mounted to said second end of said yoke such that pivoting said yoke upon said shaft provides means for adjusting the distance between said hand crank and said platform to cause a full extension of one of the upper extremities of a user standing on said platform and grasping said hand crank, thereby causing the user's body to rotate about the hips and waist, causing the user's torso to stretch and twist during cycling motion of said hand crank to exercise the muscles of the user's waist, abdomen, chest, back, and shoulders;

means for retaining said hand crank at a selected distance from said platform; and a drive train connected to said hand crank, said drive train including:

a first gear and a second gear mounted to said shaft;

drive means for transmitting force between said hand crank and said first gear;

a third gear drivingly connected to said second gear; and means for applying force to said third gear to provide a selected resistance through said drive train to cycling motion of said hand crank.

2. The exercise apparatus of claim 1 further comprising means for varying the magnitude of the exercise force applied in opposition to the manual rotation of said hand crank.

3. The exercise apparatus of claim 2 further comprising means for adjusting the axial length of said hand crank.

4. The exercise apparatus of claim 2 wherein said exercise force applying means comprises a hydraulic pump communicating with said hand crank.

5. The exercise apparatus of claim 4 wherein said exercise force varying means comprises a pressure regulator adapted to govern the hydraulic pressure applied to said hydraulic pump.

6. The exercise apparatus of claim 5 further comprising means for indicating the rotation speed of said hand crank.

7. The exercise apparatus of claim 6 further comprising a timer carried by said column.

8. An improved method of exercising the upper extremities and upper body of a user, comprising the steps of:

positioning a platform upon a support surface;

extending a column comprising a pair of struts extending from said platform in a generally vertical orientation;

mounting a shaft between said struts;

pivotally connecting a first end of a yoke to said shaft such that a second end of said yoke extends away from said shaft;

mounting a hand crank to said second end of said yoke for manual rotation in a cycling motion;

adjusting the distance of said hand crank from said platform by means of rotating said yoke about said shaft to position said hand crank at a location sufficient to cause a user standing on said base and grasping said hand crank to stretch one of the user's upper extremities to its fullest extent;

retaining said hand crank at a selected distance from the platform;

connecting first drive means between said hand crank and said shaft;

connecting a second drive means between said shaft and a hydraulic pump; and adjusting said hydraulic pump to control the resistance that the second drive means provides to rotation of said shaft by said hand crank through the first drive means.

9. The method of claim 8 further comprising the step of:

applying a rotational force in opposition to the manual rotation of said hand crank.

10. The method of claim 9 further comprising the step of:

varying the magnitude of said applied rotational force in opposition to the manual rotation of said hand crank.

11. The method of claim 10 further comprising the steps of varying the length of said hand crank.

* * * * *